US005263216A

United States Patent [19]

Vale et al.

[11] Patent Number: 5,263,216

[45] Date of Patent: Nov. 23, 1993

[54] MACHINE FOR LASTING SIDE AND HEEL SEAT PORTIONS OF SHOES

[75] Inventors: John R. Vale, Leicester; Francis B. Sharp, Syston; Mark Q. Blatherwick, Loughborough; Alan Sanderson, Sileby, all of England

[73] Assignee: British United Shoe Machinery Ltd., Leicester, England

[21] Appl. No.: 872,457

[22] Filed: Apr. 23, 1992

[30] Foreign Application Priority Data

Apr. 30, 1991 [GB] United Kingdom ..... 9109271

[51] Int. Cl.[5] ..... A43D 11/00; A43D 21/08

[52] U.S. Cl. ..... 12/1 A; 12/12; 12/14.4

[58] Field of Search ..... 12/1 R, 1 A, 7, 8.3, 12/14.3, 14.4, 14.2, 12, 12.5

[56] References Cited

U.S. PATENT DOCUMENTS

| | | | |
|---|---|---|---|
| 3,918,115 | 11/1975 | Santilli | 12/14.2 |
| 4,422,197 | 12/1983 | Christenberry | 12/1 A |
| 4,593,423 | 6/1986 | Clarkson et al. | 12/12 |
| 4,599,759 | 7/1986 | Price et al. . | |
| 4,769,866 | 9/1988 | Williams | 12/1 R |
| 4,853,997 | 8/1989 | Giebel | 12/8.3 |
| 4,920,594 | 5/1990 | Flanders et al. | 12/12 |
| 4,961,240 | 10/1990 | Schuurmans | 12/12.5 |

FOREIGN PATENT DOCUMENTS

| | | | |
|---|---|---|---|
| 0124494 | 11/1984 | European Pat. Off. . | |
| 0410368 | 1/1991 | European Pat. Off. . | |
| 2302948 | 7/1974 | Fed. Rep. of Germany | 12/14.4 |
| 2566635 | 1/1986 | France | 12/1 A |
| 2154424 | 9/1985 | United Kingdom . | |

*Primary Examiner*—Steven N. Meyers

[57] ABSTRACT

The machine comprises a shoe support (20), two side lasting assemblies (230) and a heel seat wiper mechansim (170), the shoe support comprising a last pin (24), a toe support (30) and a heel band mechanism (150). The heel band mechanism is mounted for rotation about an axis (158) whereby a shoe clamped thereby, after a lasting operation has been completed, can be removed from the operating locality of the machine onto a shoe-receiving platform (330) on to which the heel band mechanism then releases the shoe. The shoe support 30) also includes a shoe heel end positioning mechanism (86) by which a next shoe to be operated upon can be located at the operating locality of the machine during the removal of the shoe which has been lasted.

11 Claims, 13 Drawing Sheets

78
34a
32
54
38
34
36
54a
33
42
40
56
32
34
36
30
80
34a
44

MACHINE FOR LASTING SIDE AND HEEL SEAT PORTIONS OF SHOES

BACKGROUND OF THE INVENTION

This invention is concerned with improvements in or relating to a machine for lasting side and heel seat portions of shoes comprising a shoe support for supporting, bottom up, a shoe comprising a shoe upper on a last and an insole on the last bottom, two side lasting assemblies arranged one at each side of the shoe support, and a heel seat wiper mechanism comprising a pair of wiper plates, wherein the shoe support comprises a last pin for receiving the last pin hole of a shoe last, a toe support for supporting the toe end of a shoe supported by the last pin, and a heel band mechanism for clamping the heel end of such shoes prior to the operation of the heel seat wiper mechanism.

In order to improve productivity in such machines it has in the past been proposed to provide an automatic transfer device (see U.S. Pat. No. 4,599,759) whereby, when a shoe lasting operation has been completed, the shoe is picked off the last pin and removed from the operating locality of the machine. Using such a device, however, it is necessary that the shoe support be itself removed from the operating locality of the machine in order that the shoe, in being removed by the automatic transfer device, does not collide with operating parts located at such operating locality.

OBJECT OF THE INVENTION

It is thus the object of the present invention to provide an improved machine for lasting heel seat and side portions of shoes in the operation of which, after a lasting operation has been completed, the shoe can be removed expeditiously without reliance on a separate automatic transfer device requiring that the shoe support be moved out of the operating locality of the machine.

SUMMARY OF THE INVENTION

This object is resolved in accordance with the present invention, in a machine as set out in the first paragraph above, in that the heel band mechanism is mounted for rotational movement about an axis extending transversely of a shoe the heel end of which is clamped thereby, the arrangement being such that, after a heel seat lasting operation has been performed on the heel seat of the shoe and following retraction of the last pin while the heel end of the shoe remains clamped by the heel band mechanism, rotation of the latter is effective to remove the shoe from the operating locality of the machine, and in that a shoe-receiving device is provided for receiving a shoe which is held by the heel band mechanism when rotated as aforesaid, the shoe being released on to said device from said mechanism.

It will thus be appreciated that, using such a machine, no additional automatic transfer device is required and furthermore the shoe support does not move from the operating locality of the machine in order to facilitate the removal of the shoe.

For further enhancing the productivity of the machine, furthermore, preferably the shoe support also comprises a shoe heel end positioning mechanism comprising a datum member engageable by the heel end of a shoe supported by the last pin for positioning it in a direction extending lengthwise of the shoe, and a heel seat height gauge device whereby the height of the bottom of such shoe in the heel seat region thereof can be set, and wherein the shoe heel end positioning mechanism and the heel band mechanism are each movable between an operative and an out-of-the-way position, the arrangement being such that the positioning mechanism is first brought to its operative position, thus to position a shoe supported by the last pin as aforesaid, and thereafter said mechanism is moved to its out-of-the-way position and the heel band mechanism is moved to its operative position.

In this way, it will be appreciated, while the heel band mechanism is involved in the removal of the shoe from the operating locating, the operating locality is clear for the loading of the next shoe to be operated upon and this can be positioned using the shoe heel end positioning mechanism. More particularly, in a preferred embodiment the heel band mechanism, while in clamping engagement with a shoe as aforesaid, is moved to its out-of-the-way position prior to rotational movement thereof being effected.

It will also be appreciated that because of the need to release the shoe at the end of the last operation so that it remains clamped only by the heel band mechanism, the last pin must be removed from the last pin hole of the last. Moreover, the last pin must be capable of allowing sufficient movement of the shoe so that it can be moved into engagement with the datum member of the shoe heel end positioning mechanism. To both these ends, therefore, conveniently the last pin is carried by a post mounted for sliding heightwise movement in a mounting therefor to bring the heel seat region of a shoe supported by the last pin to a desired heightwise position, a locking arrangement being provided for locking the post in position on said mounting, and the mounting itself being mounted for pivotal movement about an axis extending transversely of the bottom of a shoe whereby to facilitate the movement of the heel end of the shoe into engagement with said datum member.

In conventional shoe making, the side and heel seat lasting operation follows the toe lasting operation, so that at the end of the side and heel seat lasting operation the shoe has been completely lasted. Conventionally, furthermore, such a shoe is then passed to a heat setting apparatus in which the lasting stresses which have been set up in the lasting operations can be relaxed so that the shoe retains the shape to which it has been stretched and stressed when it is subsequently removed from the last; this operation is known as a heat setting operation. In general, a heat setting operation is carried out in a machine by which heated air is directed, often at relatively high velocities, at the portions of the shoe which have undergone the greatest stress in the lasting operations; one such machine is described in detail in GB-A-2 088 195. In such a machine the shoe is placed on a conveyor bottom down. In accordance with the present invention, therefore, conveniently rotation of the heel band mechanism as aforesaid is effective to invert the shoe, which is thus released on to said shoe-receiving device in inverted condition.

The heat setting apparatus referred to above is a multi-channel machine, that is to say it comprises a plurality of channels along which a shoe can be conveyed through the apparatus for a heat setting operation to be performed thereon. In accordance with the present invention, therefore, conveniently the shoe-receiving device comprises a platform which is movable between a plurality of positions in each of which the platform is aligned with a work station of a further machine, from which platform a shoe placed thereon can be advanced on to the work station with which the platform is thus aligned. It will of course be appreciated that in this way the shoe-receiving device is arranged to deliver successive shoes to different work stations of a heat setting apparatus.

Conveniently the platform is constituted by a generally planar portion of a flexible member which at its end remote from the operating locality of the machine extends over a pulley or the like, the portion of said member beyond said pulley or the like extending at an angle away from the plane of said planar portion, the arrangement being such that as the portion constituting the platform is advanced, carrying therewith a shoe placed thereon, it progressively moves out of said plane and thus releases such shoe on to the aligned work station. Moreover, conveniently after a shoe has been received on to the platform initially the platform is advanced through a distance to release it from the heel band mechanism which is then rotated out of the way. For ensuring that the shoe moves with the belt, furthermore, preferably a pusher member is mounted for movement with the platform, said member being movable between an operative position, in which it engages a shoe received on the platform, and an out-of-the-way position.

BRIEF DESCRIPTION OF THE DRAWINGS

There now follows a detailed description, to be read with reference to the accompanying drawings, of one machine for lasting heel seat and side portions of shoe uppers, said lasting roller and machine having been selected for description merely by way of non-limiting exemplification of the present invention.

In the accompanying drawings.

DESCRIPTION OF THE PREFERRED EMBODIMENT

The machine now to be described is a so-called heel seat and side lasting machine in the operation of which heel seat and side portions of a shoe upper, which is carried on a last having an insole on the last bottom and which has already been lasted in the toe region thereof, are lasted; more particularly the lasting of the side portions is first initiated, from the region of the heel breast line toewardly, and thereafter the lasting of the seat portion is effected.

Figure 6:
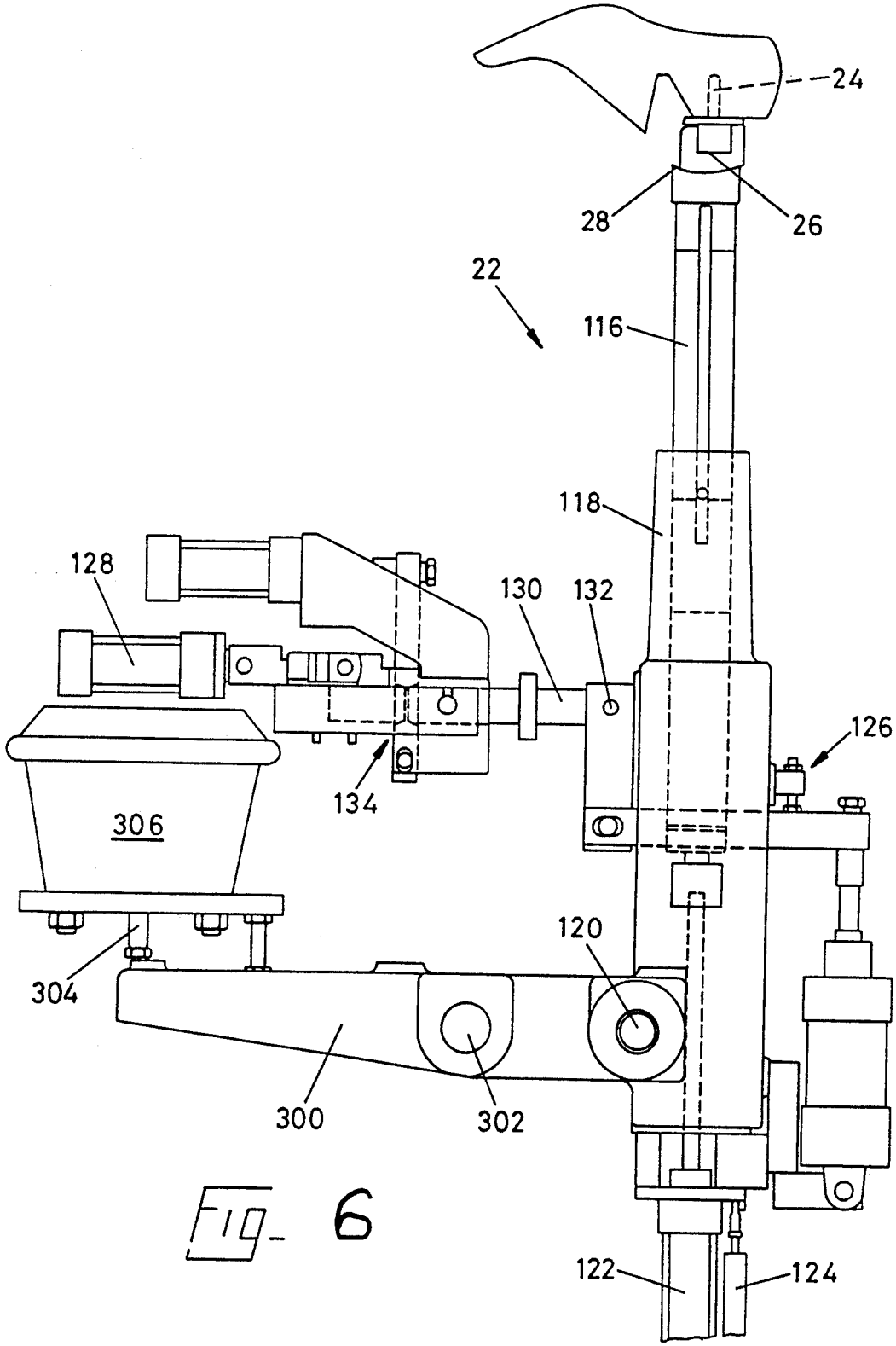
FIG. 6 shows details of a jack post forming part of the shoe support.

This machine thus comprises a shoe support generally designated 20 (FIG. 3) for supporting, bottom up, a shoe, the toe end portion of which has already been lasted, for side and seat lasting operations to be performed thereon. To this end, the shoe support 20 comprises a jack post 22 (FIGS. 3 and 6) including a last pin 2 which is capable of limited sliding movement, transversely of the longitudinal centre line of the shoe, in a slide 26 which itself is mounted for arcuate sliding movement, generally in the lengthwise direction of the shoe bottom, on a further slide 28 supported by the jack post 22. In this way it is possible for the heel seat region of the shoe bottom to be correctly levelled in relation to a wiping plane, to be referred to hereinafter, of the machine.

The shoe support 20 also comprises a toe support generally designated 30 (FIGS. 3 and 4) which comprises two blocks 32 having inwardly facing inclined surfaces which together form a generally V-shaped support surface for the toe end of the shoe. The blocks 32 are supported on a linkage comprising two levers 34, for pivotal movement towards or away from each other, a link 33 extending between the levers 34 thus to cause them to move equidistantly. The levers 34 are mounted for pivotal movement, each on its own pivot 36, on a support block 38. Extending between lower, bifurcated, ends **34*a* of the levers 34 is a piston-and-cylinder arrangement 40 by which the lower ends of the levers are drawn together or moved apart, thus effecting movement of the blocks 32 away from or towards one another. A shaft 42 is also mounted between the lower ends of the levers 34, being fixedly mounted to one of said ends and slidably accommodated in a block fixed to the bifurcated lower end 34*a* of the other. This shaft 42 forms part of a pneumatically operated bar-lock arrangement generally designated 44, by which the blocks 32** may be locked in adjusted position.

For determining the heightwise position of the toe end of a shoe in relation to the block 38, an abutment plate 54 is provided, pivotally mounted on an upstanding bracket 56 on the support block 38. The plate 54 is spring-urged into an operative position in which an inclined face of a lip **54*a* can be engaged by the tip of the toe portion of a shoe placed on the jack post, said lip thus providing a toe height datum for such shoe. As will be described hereinafter, there is associated with the plate 54 an inductance switch 58 which when the plate is pivoted by engagement with the shoe, provides a signal in response to which the blocks 32 are caused to move towards one another and thus to urge the shoe upwardly against said lip 54*a***.

The support block 38 is mounted for heightwise adjusting movement in the shoe support 20, and to this end is supported on a slide rod 46 which is mounted for vertical sliding movement in a further support block 48. The slide rod 46 threadedly receives at its lower end a ball screw 50 which in turn is connected to the output of a stepping motor 52 carried on the underside of the further support block 48. Thus, actuation of the stepping motor 52 is effective to cause heightwise movement of the support block, and thus of the blocks 32 and plate 54, to take place. In this way the heightwise position of the toe support can be determined according to the style of shoe being operated upon.

The further support block 48 is mounted for sliding movement, transversely of the shoe bottom, on a shaft 60, a rectangular bar (not shown) being provided parallel to the shaft 60 and spaced therefrom, in order to "steady" the further support block 48 as it slides along the shaft 60. The shaft 60 and bar are mounted in a carriage 64 of the toe support 30, as will be referred to hereinafter. For effecting sliding movement of the further support block 48 along the shaft 60, and thus effecting sliding movement of the blocks 32 widthwise of the shoe to be supported thereby—this facility being provided for enabling the toe ends of left and right shoes to be supported in the machine with the longitudinal centre line of their heel seat correctly positioned in relation to a longitudinal centre line of the shoe support (and thus of an operating locality of the machine of which the shoe support may form part)—a further piston-and-cylinder arrangement 66 is provided. For limiting such transverse movement of the further support block 48, furthermore, two abutments in the form of lugs 68 (one only shown in FIG. 3) are mounted for sliding movement in a channel 70, by which the lugs are restrained from any rotational movement. The lugs are themselves mounted on a threaded rod (not shown), one half of the thread being a left-hand and the other a right-hand so that upon rotation of said rod the lugs 68 are moved towards or away from one another. The rod is itself supported in the carriage 64 and is driven by a stepping motor 74 itself also mounted on the carriage 64. By appropriate signals to the stepping motor 74, therefore, it will be appreciated, the lugs 68 may be positioned in a desired relationship with one another according to the size (more particularly the width) of the toe end of the shoe to be supported by the blocks 32. Cooperating with the lugs 68, furthermore, is a pin 76 which is carried on the further support block 48. It will thus be appreciated that, by engagement of the pin 76 with one or other of the lugs 68, the position of the support block 48, and thus of the blocks 32, widthwise of the shoe, can be established.

The carriage 64 is supported at one side by a slide rod 78 and at the other by a rectangular bar 80 which extends in a direction lengthwise of a shoe supported by the last pin 24. The carriage 64 can thus slide in said lengthwise direction relative to the jack post 22 for accommodating shoes of different length. To effect such sliding movement a piston-and-cylinder arrangement 82 is provided secured at one end to a frame portion 83 of the shoe support 20 and at its other to the carriage 64. A linear potentiometer 84 is also provided, secured at one end to the frame portion 83 and at its other to the carriage 64, thus to provide a signal corresponding to the position of the toe support in relation to the jack post 22, whereby the length of a shoe to be operated upon can be "measured".

Figure 3:
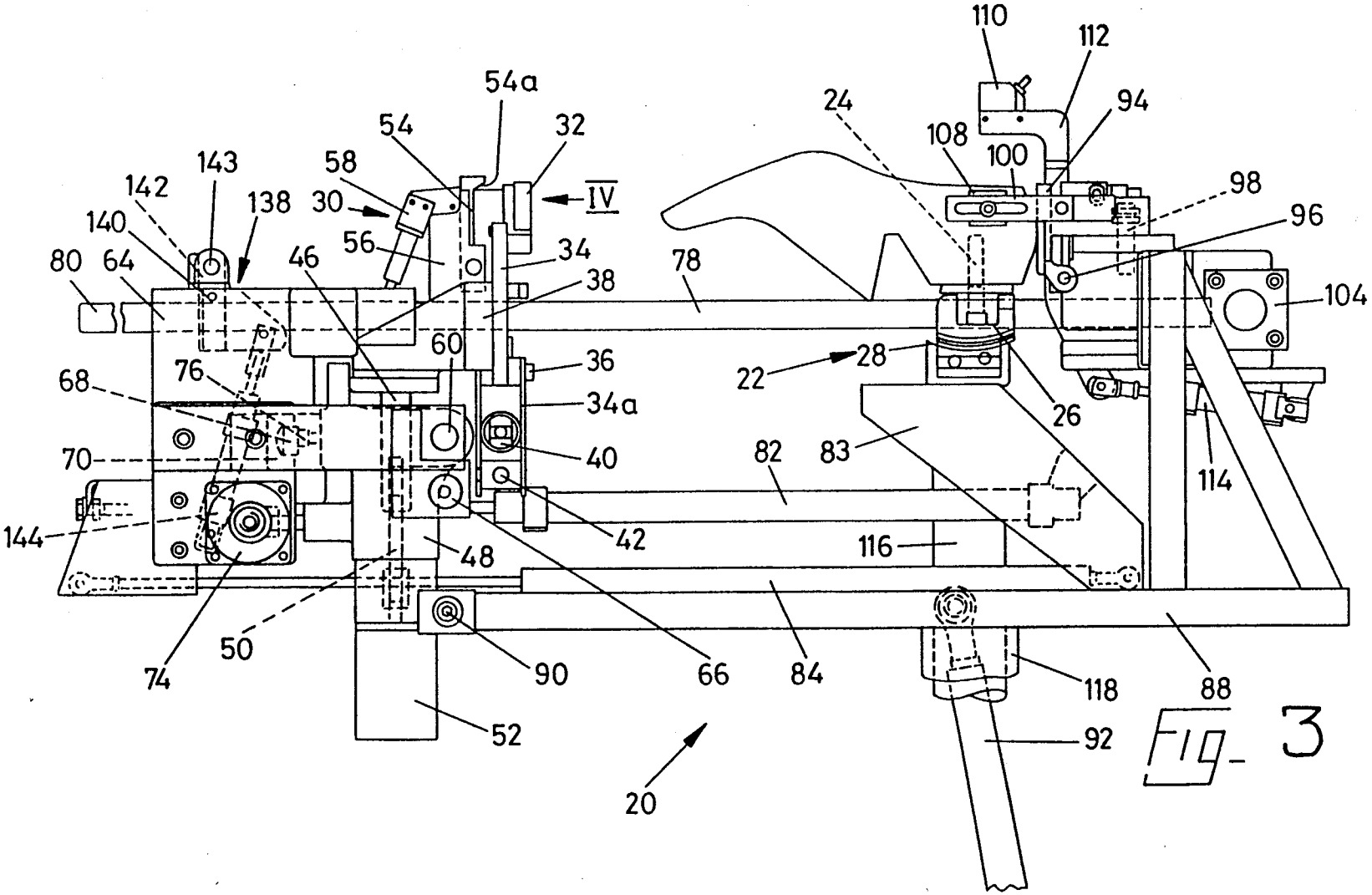
FIG. 3 is a fragmentary side view of a shoe support forming part of the machine of FIGS. 1 and 2.
Figure 4:
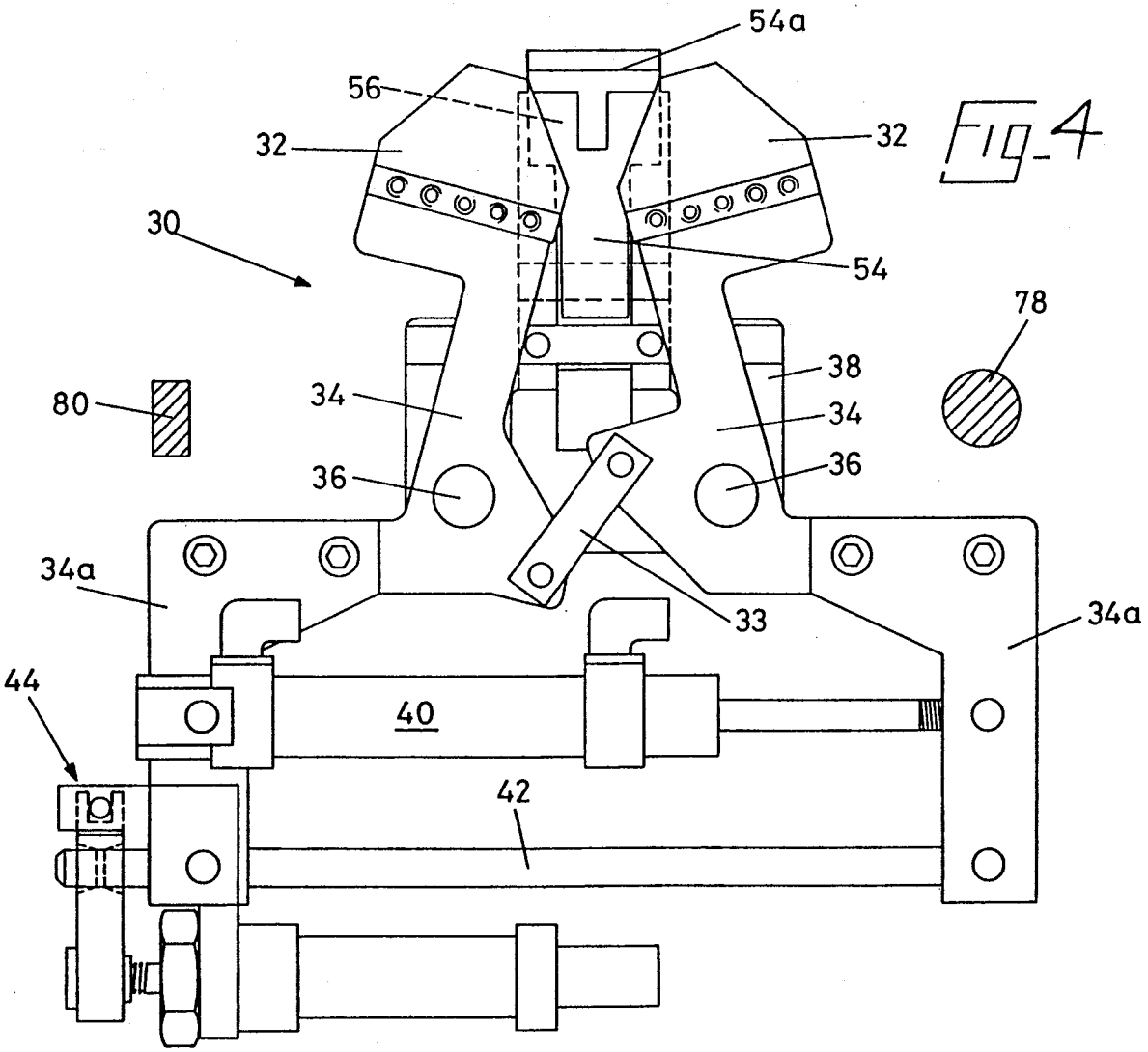
FIG. 4 is a view along the arrow IV in FIG. 3, showing details of a toe support of said shoe support.
Figure 5:
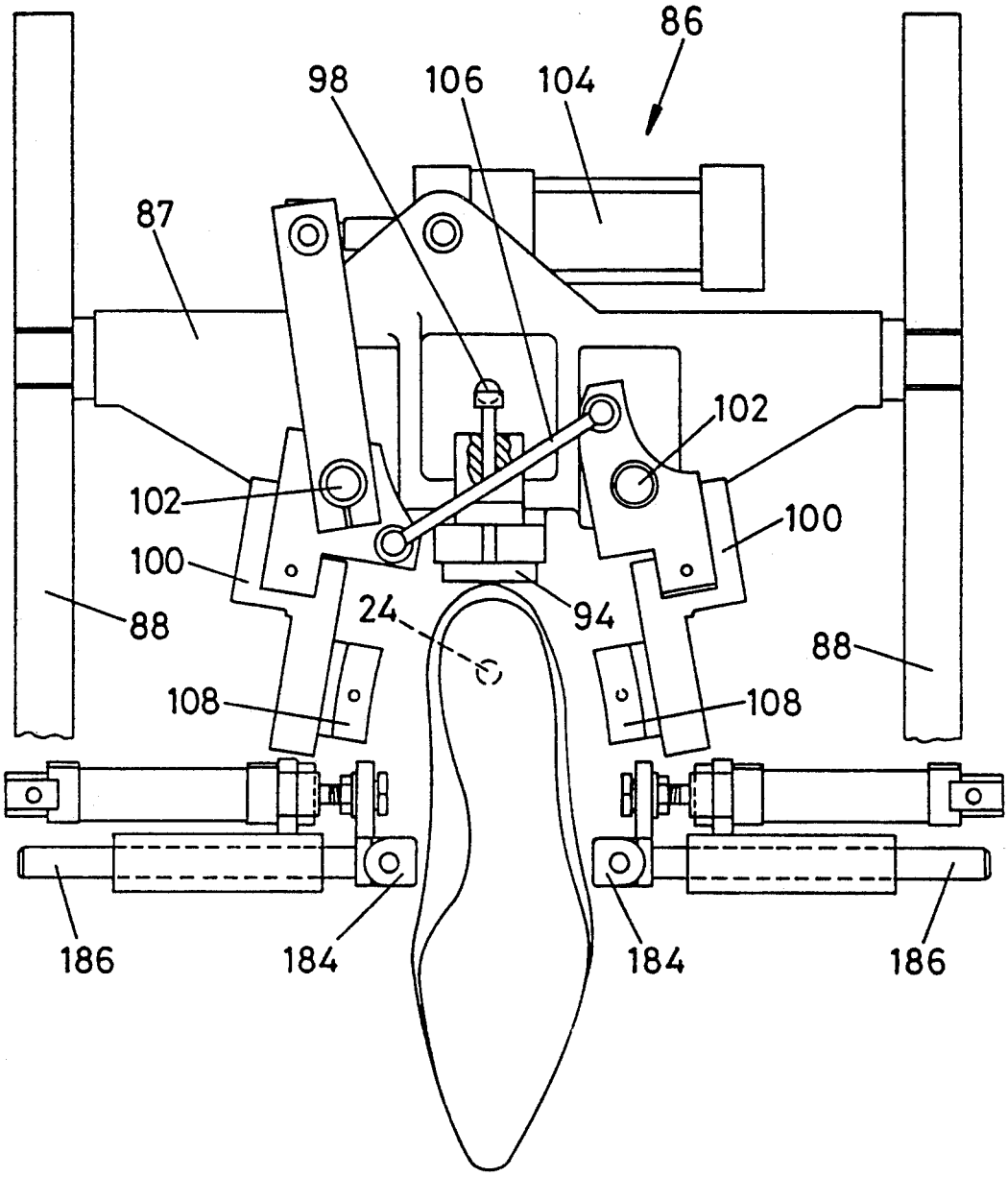
FIG. 5 is a fragmentary plan view showing details of a shoe heel end positioning mechanism of the shoe support.

The shoe support 20 also comprises a shoe heel end positioning mechanism generally designated 86 (FIGS. 3 and 5) comprising a casting 87 which is carried on a frame portion 88 mounted for pivotal movement about a pivot 90 carried on the frame of the shoe support 20. The shoe heel end positioning mechanism 86 is thus mounted for pivotal movement between an operative position (as shown in FIG. 3) and an out-of-the-way position. For effecting such pivotal movement, furthermore, two piston-and-cylinder arrangements 92 are provided, connected one to each side of the frame portion 88 and mounted on a stationary portion of the frame of the shoe support 20.

Supported by the casting 87 is a plate member 94 which can be engaged by the backseam region of a shoe placed on the jack post 22 to provide a lengthwise datum for such shoe in the shoe support 20. The plate 94 is spring-urged in a direction towards the jack post 22 about a pivot 96. When engaged by a shoe, the plate is urged in a direction away from the jack post (clockwise, viewing FIG. 3) and thus actuates an inductance switch 98 in response to actuation of which a control signal is supplied, as will be referred to hereinafter.

Also mounted on the casting 87 are two so-called seat clamp members 100, each for pivotal movement about a pivot 102 on the casting. A rearward end of one of the members 100, furthermore, is connected to a piston-and-cylinder arrangement 104, and the clamp members 100 are interconnected by a connecting rod 106 whereby they are moved equidistantly towards or away from one another. The effect of moving the clamp members 100 equidistantly towards the heel end of the shoe is to centralize the heal seat of the shoe, that is to say to locate the longitudinal centre line of the heel seat of the shoe coincident with the longitudinal centre line of the shoe support. The clamp members 100 each support a clamp pad 108 which is shaped to conform to the region of the feather edge of the shoe in the vicinity of the heel breast line.

Also mounted on the casting 87 is a heel seat height gauge device 110 (FIG. 3). This device 110 is carried on a lever 112 pivotally mounted on the casting 87, a piston-and-cylinder arrangement 114 being carried on the underside of the casting 87 for effecting such pivotal movement. The device 110 is of the photoelectric switch ("range finder") type by which the distance of an object spaced from it can be detected. Such devices are conventional and readily commercially available.

The jack post 22 comprises a post 116 (FIGS. 3 and 6) on which the slide 28 is mounted for arcuate movement, as referred to above. The post 116 is slidable, in a direction heightwise of the bottom of a shoe supported by it, in a mounting therefor in the form of a casting 118 which is mounted for limited pivotal movement about an axis 120 (FIG. 6) extending widthwise of such shoe, as will be referred to hereinafter. For effecting heightwise movement of the post 116 a piston-and-cylinder arrangement 122 is mounted on the bottom end of the casting 188 and a piston rod thereof is operatively connected with the post 116. Also associated with the movement of the post 116 is a linear potentiometer 124 by which the heightwise position of the post 116 in relation to the casting 118 can be monitored. A pneumatically operated bar lock arrangement generally designated 126 is operable to lock the post 116 in its adjusted heightwise position.

For effecting limited rocking or pivotal movement of the casting 118 on the pivot 120 a piston-and-cylinder arrangement 128 is mounted on the frame of the shoe support 20 and is connected to a rod 130 which is pivotally connected at 132 to the casting 118. The piston-and-cylinder arrangement 128 is double-acting. A further pneumatic bar lock arrangement generally designated 134 acts on the rod 130 to lock it, and thus also the casting 118 and jack post 22, in position in a direction extending lengthwise of the shoe bottom.

The carriage 64 of the toe support 20 is also provided with a bar lock arrangement generally designated 138 (FIG. 3). This arrangement comprises a locking plate 140 having an aperture through which the slide rod 78 passes and which is pivotally mounted in a support plate 142, pivotal movement of the locking plate 140 under the influence of a piston-and-cylinder arrangement 144 being effective to lock the plate 140 in relation to the slide rod 78. The support plate 142 is itself mounted in the carriage 64 for limited rocking movement about a pivot 143, the limit being determined by a stop rod (not shown). The effect of this arrangement is that after the bar lock arrangement 138 has been applied and the plate 140 is in locking contact with the slide rod 78, nevertheless the carriage is capable of limited movement, as determined by the stop rod 146, in a direction away from the jack post 22, for a purpose to be described hereinafter.

When a shoe is to be lasted, the operator first places the shoe, which has already been toe-lasted, on the last pin 24 and then urges the shoe towards the plate member 94, the slide 28, and the last pin therewith thus being caused to slide in the shoe-lengthwise direction; in addition the jack post 22, which is at this stage under merely a balancing pressure applied through the piston-and-cylinder arrangement 128 to facilitate this, moves also towards the plate 94. Upon contact between the back-seam of the shoe and the plate 94, the inductance switch 98 is actuated and a signal is thus generated in response to which firstly the heel seat height gauge device 110 is moved from an out-of-the-way position into its operative position and in addition pressure fluid is supplied to the piston-and-cylinder arrangement 82 to cause the carriage 64, and thus the toe support 30, to move towards the jack post 22. The arrangement is such that initially fluid under relatively high pressure is applied to the arrangement 82 in order to initiate such movement, whereafter the pressure is reduced, but nevertheless is sufficient to maintain the movement of the carriage. At the stage, furthermore, the blocks 32 are spaced apart.

As the toe support 30 reaches the toe end of the shoe, sides of the toe end are engaged by the blocks 32 and the tip of the toe end of the shoe is engaged beneath the lip **54*a* of the abutment plate 54, whereupon the latter is rocked anti-clockwise (viewing FIG. 3) and a signal is thus generated in response to the consequent actuation of the inductance switch 58. In response to this signal firstly the bar lock arrangement 138 is applied, thus to lock the carriage 64 in position, whereafter fluid pressure is applied to the opposite side of piston-and-cylinder arrangement 82 thus to allow the carriage 64 to retract slightly from the plate member 94, within the constraints of the pivotal movement of the support plate 142. In this way the shoe is maintained in position without its being at this stage forced against the plate 94. In this condition the signal generated in response to actuation of the inductance switch 58 is then effective to cause simultaneously the blocks 32 to move towards one another and also to cause the post 116 of the jack post to rise in response to the application of pressure fluid to piston-and-cylinder arrangement 122. The upward movement of the jack post, which can thus take place without the shoe being forced against the plate 94 and thus being dislodged on its last, is monitored by the device 110 which cooperates with the linear potentiometer 124 to bring the insole on the shoe bottom to the height datum of the shoe support. This height datum is determined in relation to the previously mentioned wiping plane of the machine. The inward movement of the blocks 32 serves, by reason of the inclined surfaces thereof, to force the shoe toe against the under-side of the lip 54*a*** thereby establishing the toe of the shoe at the desired toe height datum, and at the same time serves to centralise the toe end of the shoe.

In this regard, it should be noted that the machine will have been set up previously according to whether the shoe to be operated upon is a left or a right, and the support block 48 will have been positioned accordingly, as determined by the engagement of the pin 76 with one or other of the lugs 68. Moreover, the position of the lugs will have been determined according to the style of shoe being operated upon, as will also the height of the toe support 30.

At this stage the seat clamp members 100 are moved inwards so that their pads 108 engage and clamp the shoe at the level of the featherline in the region of the heel breast line thereof, and thus centralise it. The device 110 is then retracted. Thereafter the application of fluid pressure to the piston-and-cylinder arrangement 82, to urge the toe support 30 away from the jack post 22, is discontinued and also the bar lock arrangement 44 is applied, locking the blocks 32 in position.

With the shoe thus positioned its length can then be "measured" by the linear potentiometer 84 in readiness for the subsequent lasting operation.

Figure 7:
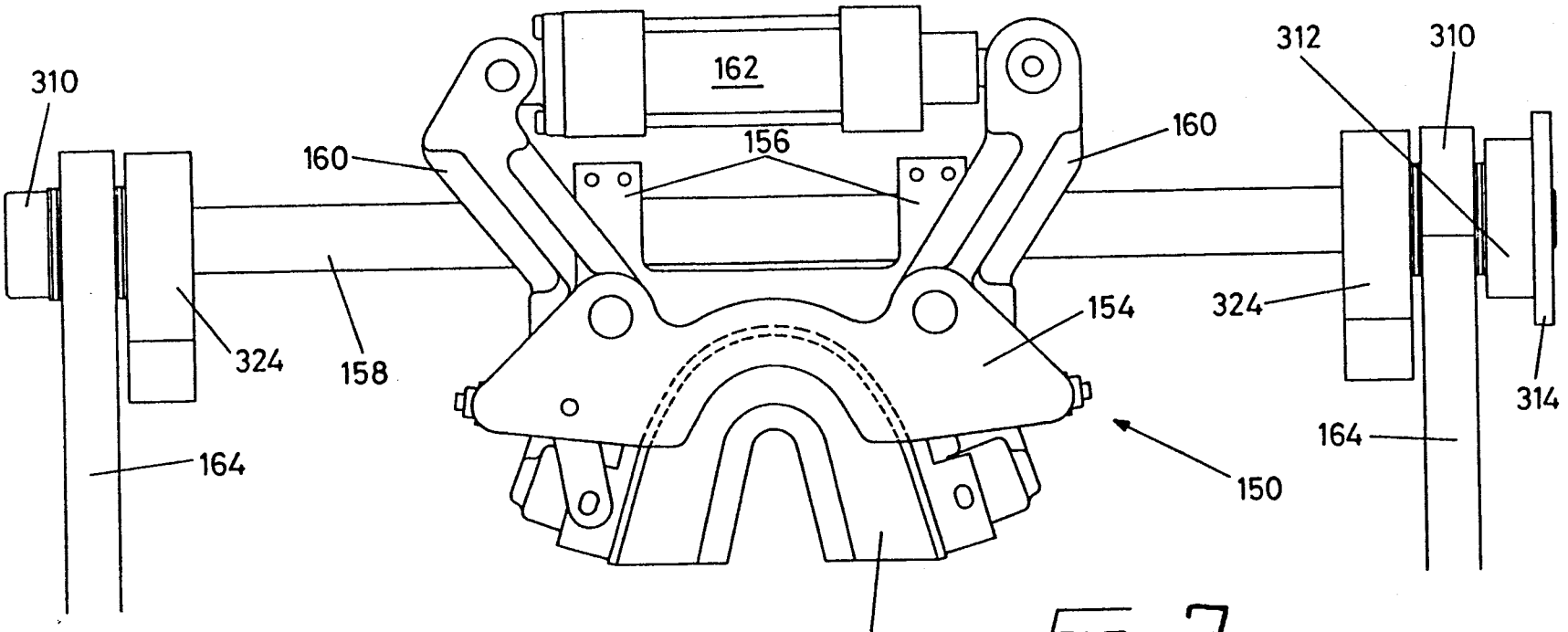
FIG. 7 shows details of a heel band mechanism forming part of the shoe support.

The machine in accordance with the invention also comprises a heel band mechanism generally designated 150 (FIGS. 7, 8 and 9) by which a conventional heel band 152 can be brought into engagement with the heel end of a shoe supported by the shoe support 20; it will of course be appreciated that in order for this mechanism to engage the heel end of a shoe it will first be necessary to remove the shoe heel end positioning mechanism 86 from engagement with such heel end, for which purpose of course said mechanism is mounted on the frame portion 88 for pivotal movement about the pivot 90 into and out of an operative position as aforesaid.

The heel band mechanism 150 comprises a casting 154 provided with two rearwardly extending lugs 156 by which the casting is mounted on a support rod 158 extending in a direction transversely of the shoe bottom. Mounted on the casting, one at each side thereof, are two bell crank levers 160 forward (i.e. towards the jack post 22) ends of which support wing portions of the heel band 152. Supported between the rearward ends of the levers 160 is a piston-and-cylinder arrangement 162 actuation of which is thus effective to move the forward ends of the levers 160 towards or away from one another, thus to enable the heel end of a shoe to be clamped and subsequently released by the heel band 152.

Figure 8:
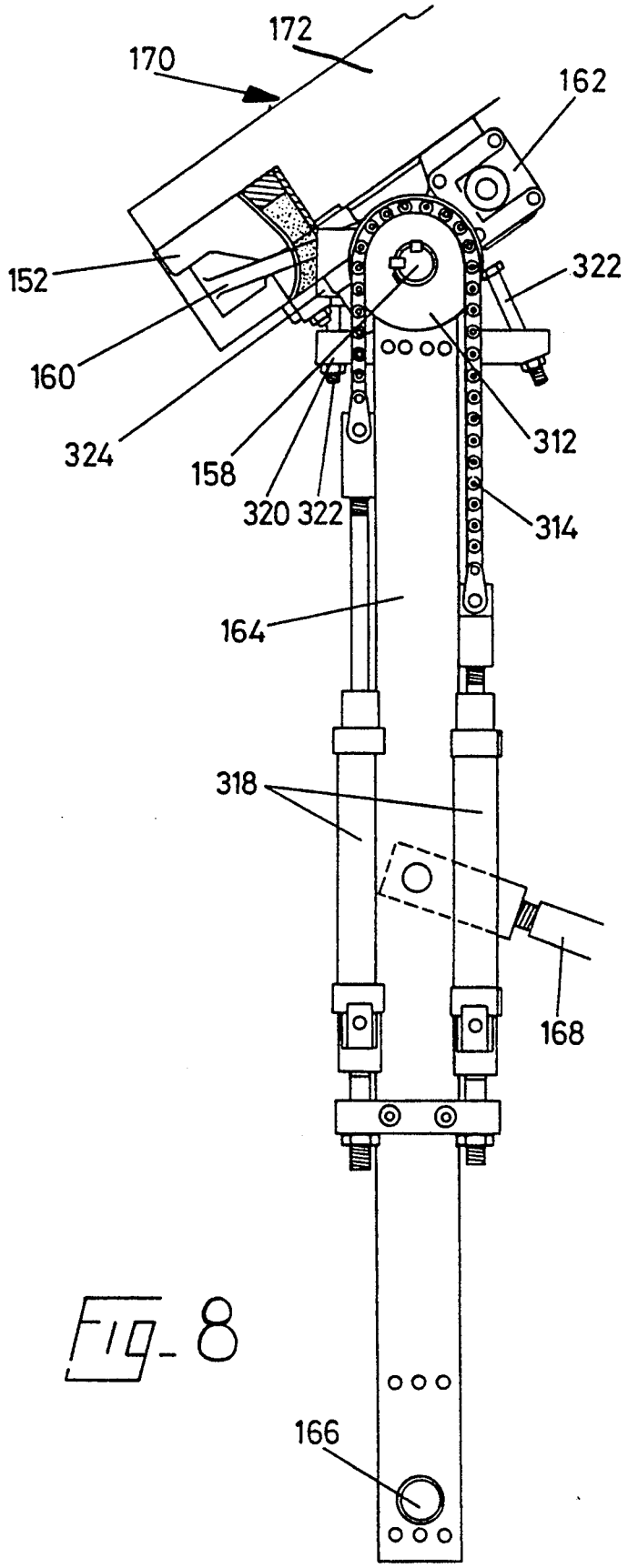
FIG. 8 shows details of the heel band mechanism and its support, the heel band mechanism being shown in its operation position in which it can clamp the heel end of a shoe supported by the last pin.
Figure 9:
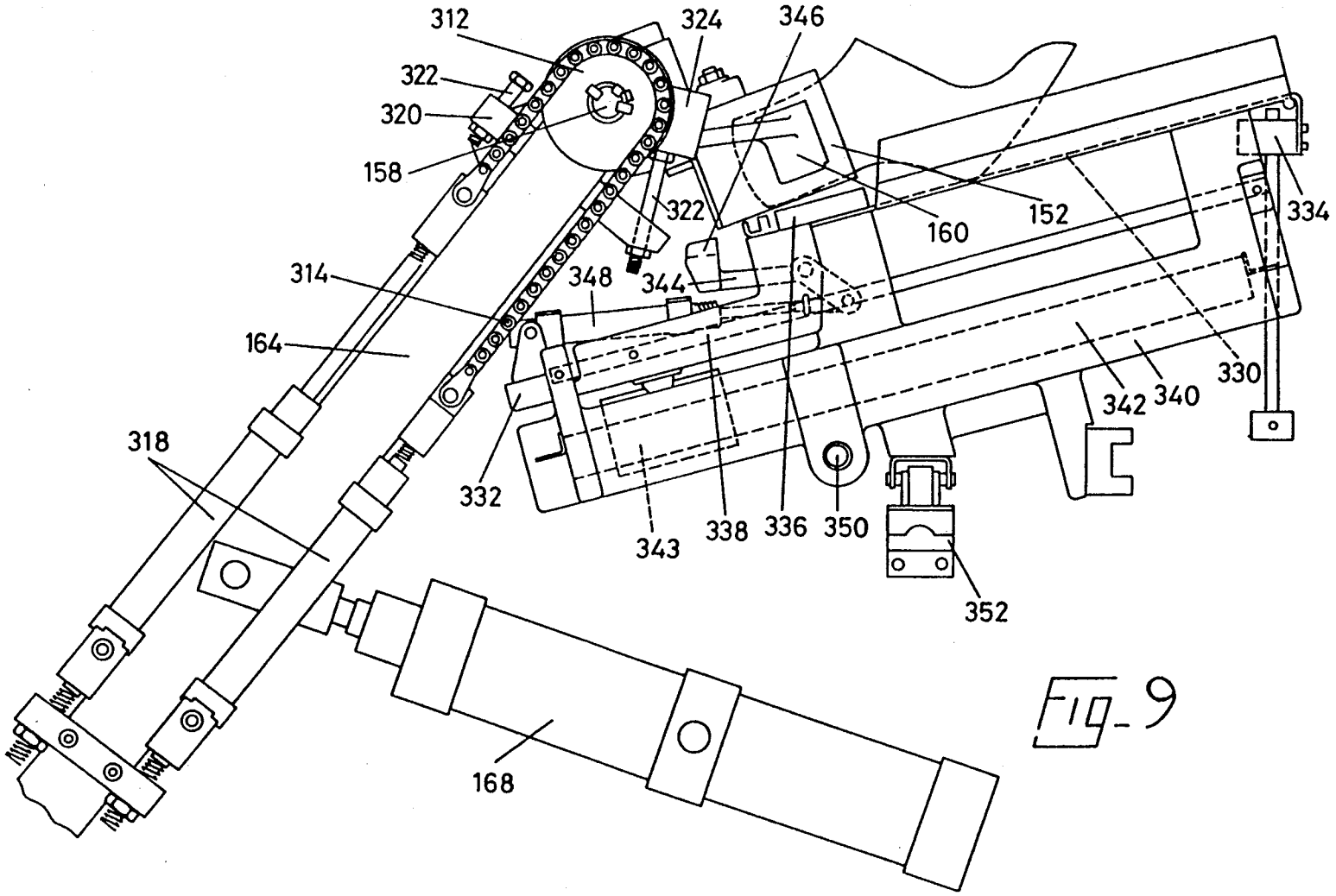
FIG. 9 shows details of the shoe removal system of the machine, including the heel band mechanism when in an out-of-the-way position.

The support rod 158 is itself supported at its opposite ends by a frame 164 which is mounted for pivotal movement, about an axis 166 extending widthwise of the bottom of a shoe supported by the shoe support, whereby the heel band mechanism 150 can be moved between an operative position (see FIG. 8), in which it can engage the heel end of a shoe supported by the last pin 24, and an out-of-the-way position (see FIG. 9). A piston-and-cylinder arrangement 168 is mounted on a stationary portion of the machine frame and is connected to the frame 164 to effect such pivotal movement.

The machine also comprises a wiper mechanism generally designated 170 (FIG. 10) which is of generally conventional construction and comprises a wiper head 172 which is slidable towards and away from the jack post 22 under the action of a piston-and-cylinder arrangement (not shown). The wiper head supports a pair of wiper plates 174 which, under the action of a cam plate 176, effect a forward and inward wiping movement over the heel end of a shoe. The wiper head 172 is bodily movable into an operative position, this position being determined by a block 178 engaging a back surface of the heel band 152 and urging the heel band into engagement with the backseam region of the shoe; in this way the wiper head is always positioned in a desired relationship with the heel end of the shoe prior to initiation of the forward and inward wiping movement of the wiper plates. More particularly, the block 178 is mounted on a spigot 180 which is accommodated within the wiper head and spring-urged in a direction away from the jack post, an adjustable stop pin 182 being provided in the block and engaging with a surface of the wiper head thus to determine the position of the block in relation to the wiper head. The block 178 is provided with two wings 178*a*, at opposite ends thereof, by which it engages and presses on the back surface of the heel band 152 at opposite sides of the backseam region thereof. It will thus be appreciated that by varying the position of the stop pin 182, the relationship between the initial position of the wipers prior to the start of the forward and inward wiping movement thereof, and thus the amount by which the wiper plates over-wipe the shoe upper, can be pre-set.

It will be appreciated that, because the heel band is, in its final stage of movement, urged into engagement with the heel end of the shoe by the advancing wiper head 172, it moves in a direction which is parallel, or substantially so, to the plane in which the heel seat of the shoe is located, thereby minimising the risk of dislodging the upper on its last, which could of course occur if the band followed an arcuate path into clamping engagement therewith.

After the heel end of the shoe has been engaged by the heel band in the aforementioned manner, actuation of the piston-and-cylinder arrangement 162 is effective to close the wings of the heel band 152 under clamping pressure against the sides of the shoe.

The shoe support 20 is provided, in addition to the seat clamp members 100, with two further or auxiliary side clamp members 184 (FIG. 5), mounted, one at each side, on a frame portion of the shoe support and movable into engagement with a shoe supported by the shoe support under the action of piston-and-cylinder arrangements 186. The side clamp members 184, as will be explained later, cooperate with the toe support 30 to maintain the shoe firmly in the shoe support when the seat clamp members 100, which of course form part of the shoe heel end positioning mechanism 86, are retracted prior to the heel band 152 being brought into engagement with the heel end of the shoe.

Figure 1:
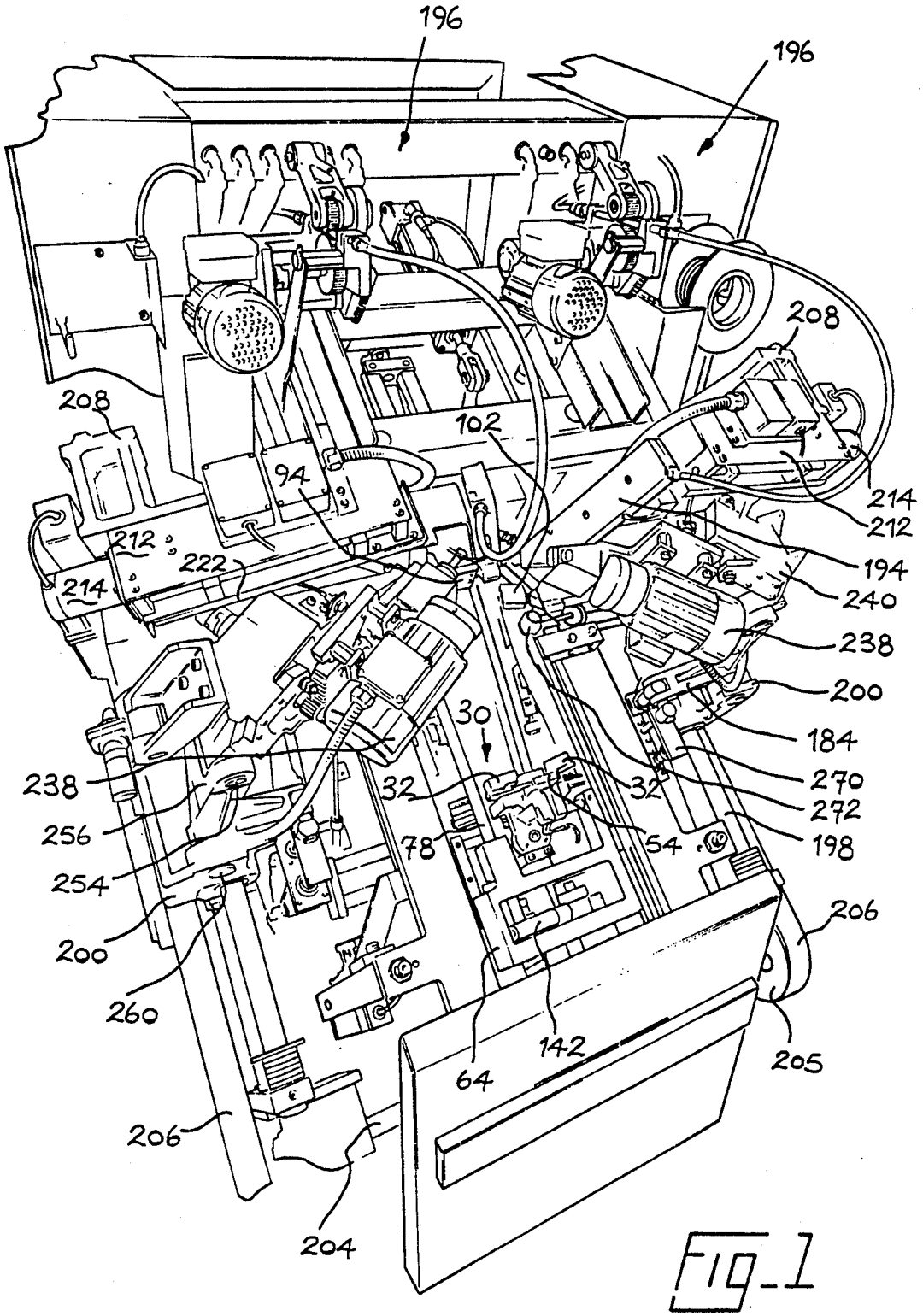
FIG. 1 is a front perspective view, with parts broken away, of a machine for lasting side and seat portions of shoe uppers in accordance with the present invention.
Figure 12:
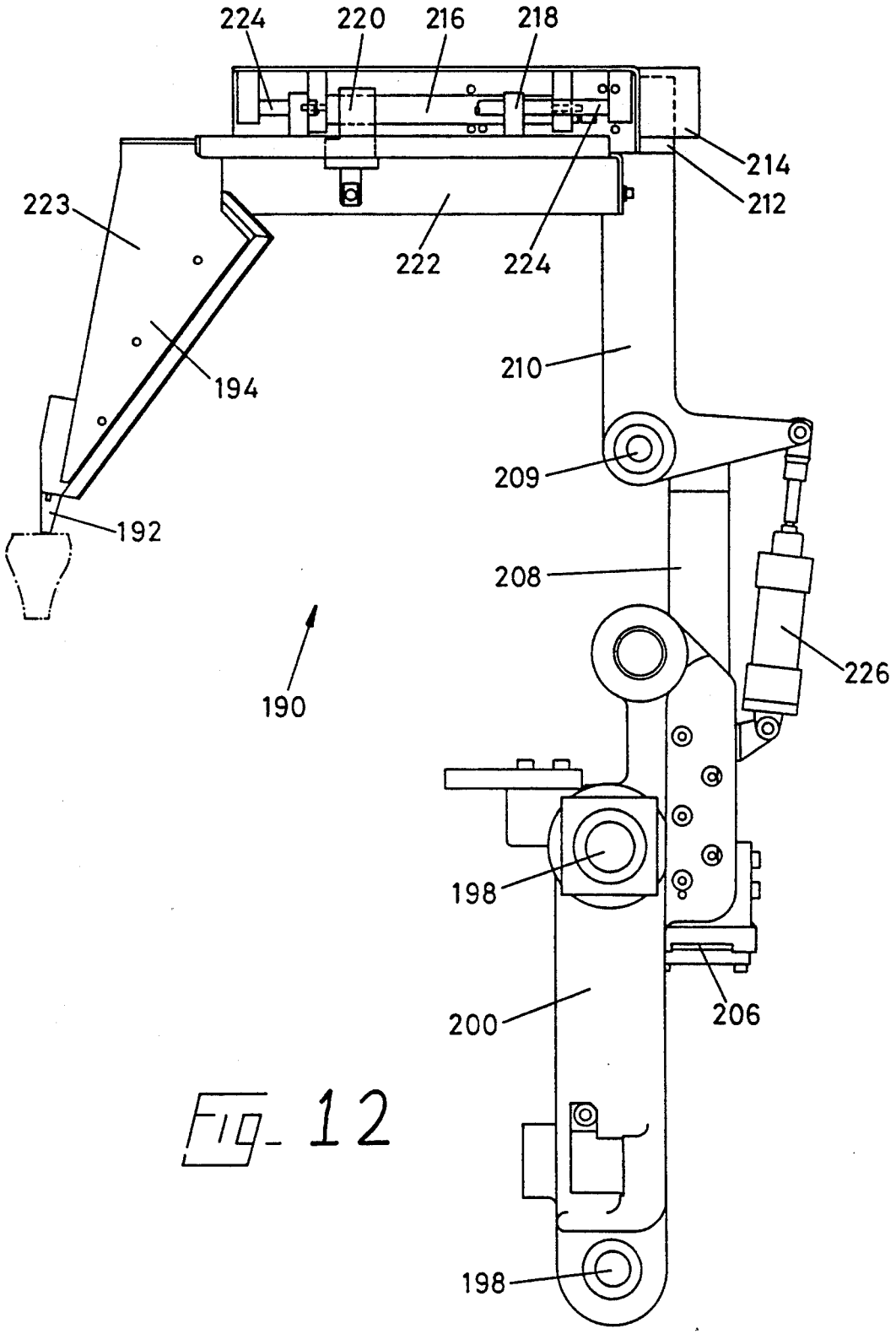
FIG. 12 shows details of the adhesive-applying means of the machine.

The machine in accordance with the invention also comprises adhesive-applying means generally designated 190 (FIG. 12). said means 190 comprises two nozzles 192 with each of which is associated a melt chamber 194 and a feed mechanism generally designated 196 (see FIG. 1) by which adhesive in rod form can be fed to the melt chambers 194. The feed mechanism 196 in each case is generally as described in U.S. Pat. No. 4,599,759 and will not be further described here.

The nozzles 192 follow independent paths along marginal portions of opposite sides of the insole, each path being under any suitable control, preferably however under programmed control. The two nozzles are similarly mounted (but on a mirror-opposite basis) and only one will now be described.

Figure 11:
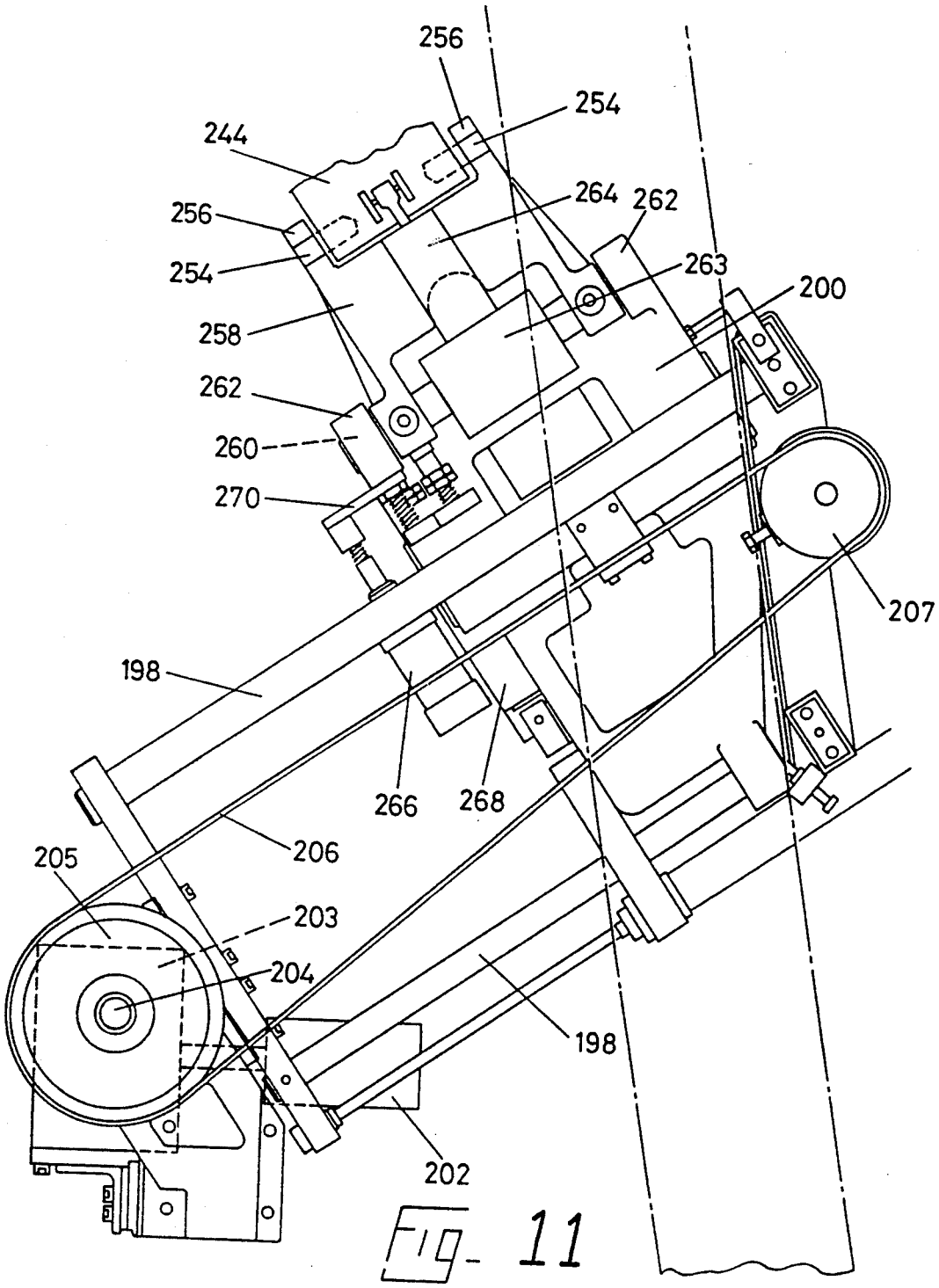
FIG. 11 is a fragmentary side view illustrating a carriage for adhesive-applying means and a side lasting assembly of the machine in accordance with the invention.

Extending along the outside of the main machine frame are two parallel slide rods 198 (FIGS. 11 and 12) on which a carriage 200 is movable. To this end a stepping motor 202 is effective through a gearbox 203 to drive a drive shaft 204 having drive pulleys 205 at opposite ends thereof. Around each pulley a timing belt 206 is entrained, which is connected to the carriage 200. Idler pulleys 207 are arranged at the opposite ends of the slide rods 198.

Mounted on a bracket 208 (FIG. 12) upstanding from the carriage 200, for movement about a pivot 209, is a lever 210 on which in turn a carrier block 212 is supported. The carrier block 212 supports a stepping motor 214 which drives a ball screw 216 captively supported on blocks 218 secured to the carrier block 212. Operatively connected to the ball screw 216 is a drive block 220 on which a plate 222 is carried for sliding movement along slide rods 224 supported by the carrier block 212. The melt chamber 194 is supported by a bracket 223 on an end portion of the plate 222 and thus is movable in a direction extending transversely of the shoe bottom under the action of the stepping motor 214. In this way, and by reason of the lengthwise movement of the carriage 200 for the nozzle under the action of the stepping motor 200, the nozzle 192 can be caused to track in X and Y directions along the shoe bottom.

In order to accommodate heightwise variation in the shoe bottom contour, the lever 210 is urged about the pivot 209, so as to maintain contact between the nozzle and the shoe bottom, under the action of a piston-and-cylinder arrangement 226 mounted on the carriage 200.

Figure 10:
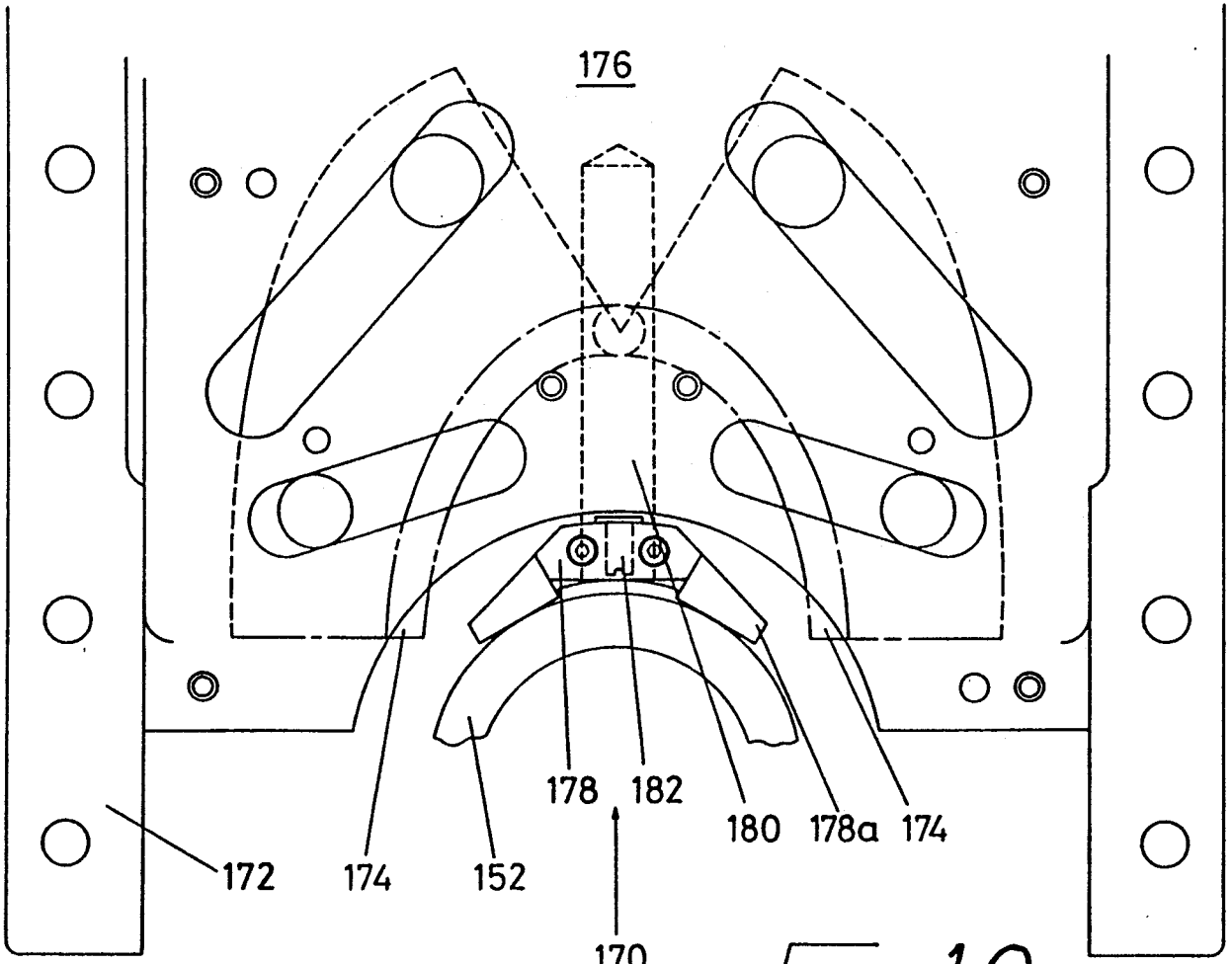
FIG. 10 shows details of a wiper head of the machine in accordance with the invention.

The machine in accordance with the invention still further comprises two side lasting assemblies generally designated 230; these two assemblies are also mirror-opposites and only one will therefore now be described with reference to FIGS. 8 and 10. Each side lasting assembly 230 comprises a lasting roller 232, which is mounted in a bearing 234 and is driven through a system of belts and pulleys generally designated 236 by a motor 238. The parts of the assembly 230 just described are all mounted on a support plate 240, itself mounted for pivotal movement, about an axis 242, on a casting 244. For effecting such pivotal movement a gear segment 246, having a centre of curvature at the pivot 242, is mounted on the plate 240 and meshes with a drive pulley 248 which is driven, through a further system of timing belts and gears generally designated 250, from an output shaft of a stepping motor 252 mounted on the casting 244. It will thus be appreciated that the stepping motor 252 controls the angle of tilt of the lasting roller about the axis 242, whereby the roller can accommodate to the widthwise contour of the shoe bottom being operated upon.

The casting 244 is itself mounted for pivotal movement on stub shafts 254 extending inwardly of lugs 256 formed on a carrier block 258 which is itself carried on a further shaft 260 supported at opposite ends by lugs 262 formed on the carriage 200. Also mounted on the shaft 260, between the lugs 262, is a mounting 263 for a piston-and-cylinder arrangement 264 by which the casting 244 is urged in such a direction that the lasting roller is held against the shoe bottom as it is caused to operate progressively therealong.

Figure 13:
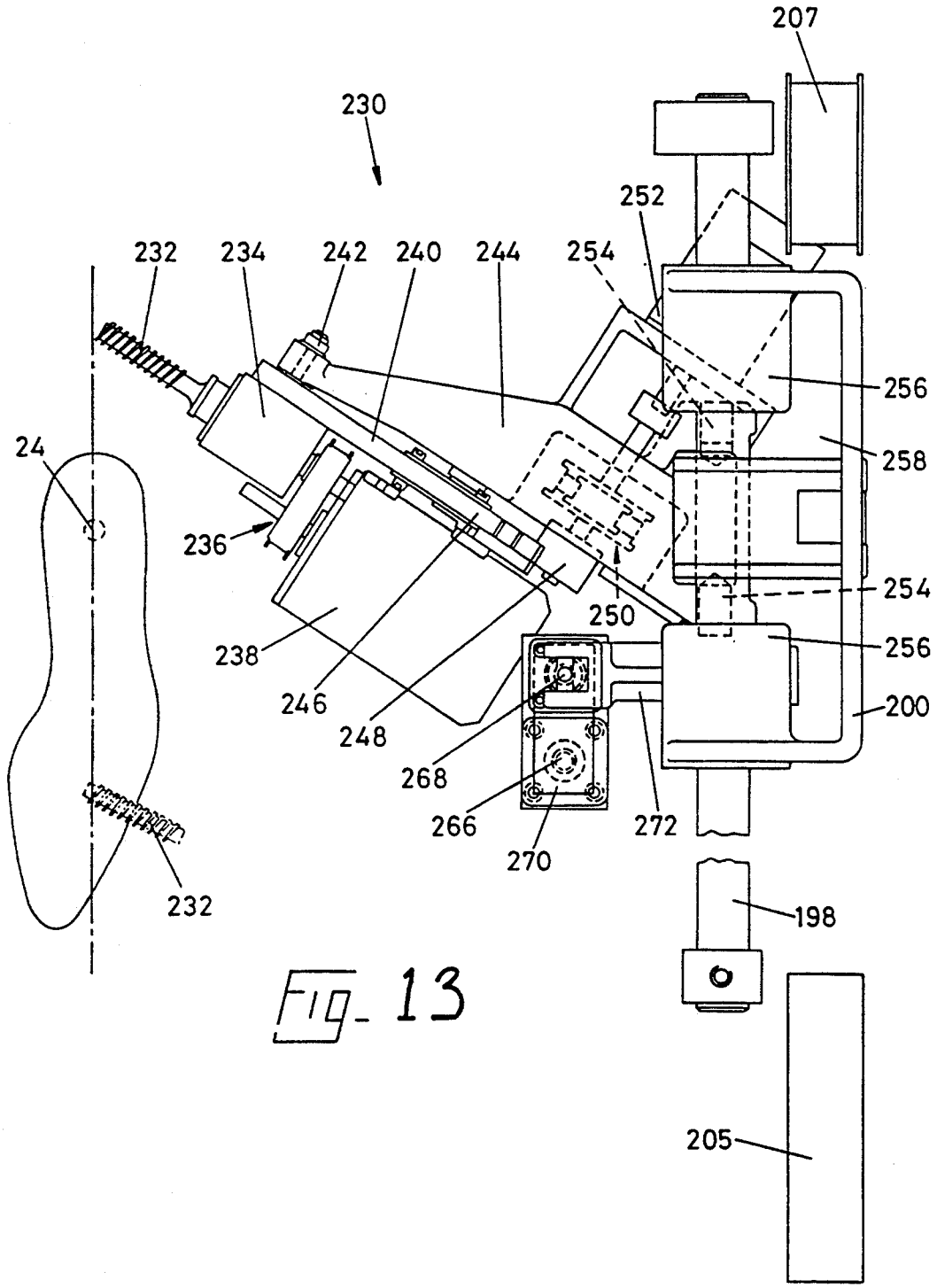
FIG. 13 shows details of a side lasting assembly of the machine.

The machine further comprises means for effecting pivotal movement of the carrier block 258 about the shaft 260, said means comprising two piston-and-cylinder arrangements 266, 268 which are mounted on the carriage 200 and are caused to act upon a plate 270 secured to an inwardly directed arm 272 integral with the carrier block 258. The piston-and-cylinder arrangement 266 is generally actuated so that its piston rod is fully extended and in this case the lasting roller is held with its tip at or adjacent the longitudinal centre line of the shoe support 20, as shown in full line in FIG. 13. In this condition the piston rod of the piston-and-cylinder arrangement 268 is at an intermediate position such that it can be either further extended or fully retracted when the piston-and-cylinder arrangement 266 is de-actuated. In this way, the piston-and-cylinder arrangement 268 is effective to cause pivotal movement of the carrier block 258 which results in the lasting roller being either urged over, i.e. beyond, the longitudinal centre line of the shoe support 20 (in the case of extension of the piston rod of the arrangement 268), as shown in chain-dot line in FIG. 13, or being withdrawn from adjacent said longitudinal centre line (in the case of retraction of said piston rod). It will of course be appreciated that the two lasting rollers must be actuated together so that as one is moved beyond the longitudinal centre line the other is withdrawn and vice versa, in order to avoid collision. The purpose of this so-called "shogging" movement is to enable the lasting rolls to track along opposite marginal portions of the shoe bottom which are not symmetrical along the longitudinal centre line of the shoe support, and indeed one of which may, especially toward the end, cross such longitudinal centre line.

It will be recalled that the casting 188 of the jack post 22 is mounted for limited pivotal movement about the axis 120. The axis 120 is in the form of a pivot pin which is itself mounted on a lever 300 (FIG. 6) which can rock about a pivot 302 secured to a stationary frame portion of the machine. The opposite end of the lever 300 provides an abutment surface against which a piston rod 304 of a diaphragm-type piston-and-cylinder arrangement 306 can act, the arrangement 306 also being mounted on a stationary frame portion of the machine. In this way, as will be referred to hereinafter, bedding pressure may be applied to the heel seat of a shoe supported on the last pin 24.

Also as mentioned previously, the heel band mechanism 150 is mounted on the support rod 158. This rod is, in turn, supported in the frame 164 pivotable about the axis 166. The support rod 158, furthermore, is mounted for limited rotational movement in the frame 164, to which end it is supported in bearings 310 (FIGS. 7, 8 and 9) at its opposite ends. At the right-hand end (viewing FIG. 7) of the support rod 158, furthermore, is a gear 312 about which is entrained a chain 314 opposite ends of which are secured each to the piston rod of a piston-and-cylinder arrangement 318. These arrangements 318 operate in conjunction with one another to maintain the chain 314 taut and also to rotate the gear 312, and thus the support rod 158, about its axis of rotation. For limiting such rotational movement, furthermore, two bars 320 are secured to the frame 164, and each supports two adjustable stop pins 322. The pins 322 serve to limit the amount of rotation of the support shaft 158, and thus of the heel band mechanism 150, by engagement therewith of a block 324, there being two such blocks mounted one at each end of the support rod 158.

It will be appreciated that by the rotation of the heel band mechanism about the axis of rotation of the rod 158, in circumstances where the heel end of the shoe remains clamped by the heel band 152, such shoe can thus be removed from the operating locality of the machine and at the same time be inverted.

For cooperating with the heel band in the removal of a shoe from the machine, there is mounted at the rear of the machine a shoe-receiving platform 330 (FIG. 9) arranged at an unloading position aligned with the heel band. The platform 330 is intended to facilitate the advancing of a shoe placed thereon selectively into various channels of a heat setting apparatus generally of the type described in U.S. Pat. No. 4,599,759, which is a multi-channel machine. To this end, the platform 330 is in the form of a belt which is connected to a slide 332 at one end and carries a weighted block 334 at the other, the arrangement being such that as the slide 332 is advanced away from the operating locality of the machine and towards the heat setting apparatus, the block 334 can slide vertically, thereby maintaining the belt 330 taut, as the shoe is transferred from the gradually diminishing portion of the belt into one of the channels of the apparatus. More particularly, the belt 330 has, at its end nearer the operating locality of the machine, a pad 336 on to which the heel end of the shoe is placed when the heel band 152 is pivoted to remove the shoe from the operating locality of the machine. The slide 332 is mounted for sliding movement on slide rods 338 carried by a frame portion 340, a pneumatic actuator 342 cooperating with a block 343 mounted on the slide 332 for effecting sliding movement thereof. Associated with the slide, furthermore, is an arm 344 having a V-shaped shoe-engaging member 346 and being pivotally mounted for movement from an out-of-the-way position firstly to cause said member 346 to engage the heel end of the shoe in the backseam region thereof and then to urge the shoe relative to the platform 330, thus to move the heel end of the shoe off the pad 336. For effecting such pivotal movement as aforesaid a further piston-and-cylinder arrangement 348 is provided.

In the course of the shoe removal operation, after a shoe has been deposited on the platform 330 the heel band is caused to release the heel end of the shoe, and thereafter, prior to the operation of the arm 344 as aforesaid, the slide 332 is moved slightly in a direction away from the operating locality to remove the heel end of the shoe from within the band, whereafter the band can be returned to its position in readiness for the next lasting operation to be effected.

Figure 2:
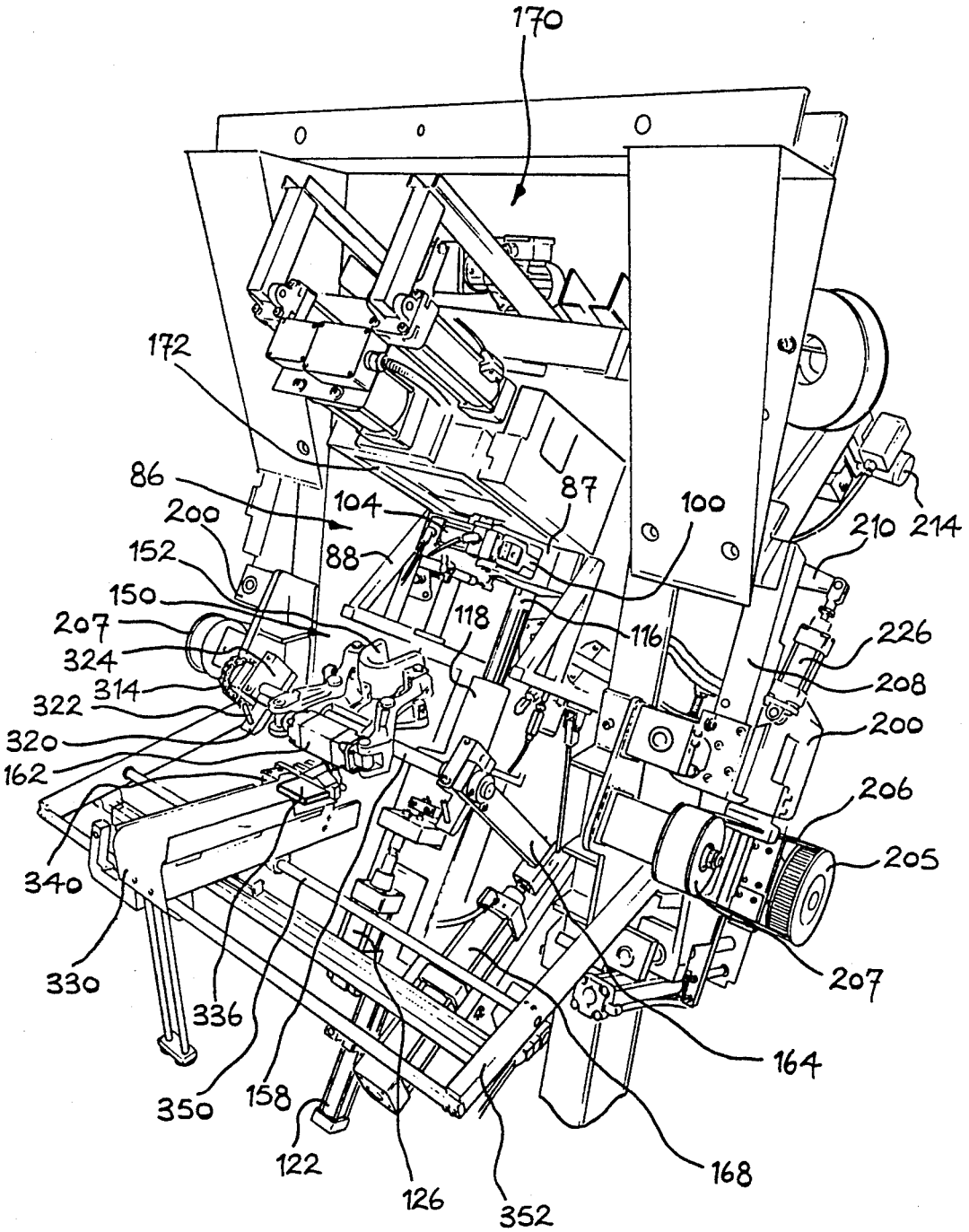
FIG. 2 is a rear perspective view of the machine shown in FIG. 1, showing in particular a shoe removal device of the machine.

The frame 340 is itself mounted for sliding movement, transversely of a shoe supported thereby, and to this end is mounted on transverse slide rods 350 fixedly supported in a frame 352 (FIG. 2) on the back of the machine. The frame 340 can thus slide transversely of the machine between positions of alignment with each of the plurality of channels of the heat setting apparatus, and can thus align the platform 330 with a selected channel, so that successive shoes are loaded sequentially into successive channels of the heat setting apparatus, and thereafter be returned to an initial position in which the platform 330 is in its loading position. Sliding movement of the frame 340 as aforesaid is effected by a pneumatic actuator 352, the control of the operation of which is preferably programme controlled.

In using the machine described above, with a shoe supported by the shoe support 20 the machine cycle is initiated whereby firstly the side clamp members 184 are moved inwardly against the shoe upon actuation of piston-and-cylinder arrangements 186. At the same time, the nozzles 192 of the adhesive applying means 190 move downwardly into engagement with the insole of the shoe toewardly of the backseam region thereof by the action of piston-and-cylinder arrangements 226, and thereafter they are moved heelwardly by the action of the stepping motor 202, acting on the carriages 200. At this stage the nozzles are closely adjacent one another so that they move to a position in the region of the back seam and adjacent the insole edge. If the lasting margin has previously been in-flanged, then the nozzles move beneath such in-flanged portion. In this position the feed mechanisms 196 for the adhesive are initiated so that adhesive is then applied from the nozzles to the insole and, under the influence of stepping motors 214 and stepping motor 202, the nozzles are caused to move along a predetermined path which is preferably parallel to the insole edge thus to apply adhesive from the backseam region of the shoe bottom toewardly up to the previously lasted toe portion of the shoe.

The path may be controlled by any conventional means. For example, and indeed preferably, the path of the nozzles has previously been digitised, in terms of coordinate axis values which are directly then applicable to the stepping motors referred to; conveniently the paths are reversible for left and right shoes and in addition, according to the length of shoe as measured by the linear potentiometer 84, the paths are graded.

At this stage the rollers 232, which are still held out of engagement with the shoe bottom, are caused to begin rotation under the action of motors 238 and, when the nozzles have moved sufficiently forwards of the heel breast line region of the shoe bottom by a distance more or less equal to the spacing between the nozzles and the rollers (approximately 75 mm in the machine described above), the rollers are moved downwardly under the action of piston-and-cylinder arrangements 264 and engage the lasting marginal portions of the shoe upper. By reason of the rotation of the lasting rollers 232 as described above, furthermore, the helical rib arrangement 294 of each effects an inwiping movement on such lasted marginal portion at the point of engagement and also presses said lasting marginal portion against a corresponding marginal portion of the insole, thus causing the two marginal portions to be bonded together by the previously applied adhesive.

Although at each side of the machine the nozzle and side lasting roller are mounted on a common carriage, namely the carriage 200, nevertheless they are capable of independent widthwise movement and indeed heightwise movement, so that both can track along the shoe bottom and indeed their operating path can be terminated independently. When a programmed control is provided, the boundary of the previously toe-lasted portions of the shoe bottom can be "taught" and thus it can be ensured that both the nozzles and thereafter the rollers are lifted of when such boundary region has been traversed. Moreover, the cement feed mechanisms 196 are switched off some 20 to 30 mm from the taught position, so that there is no excess of adhesive at the termination of the nozzle path, and in addition, the feed mechanisms 196 are so arranged that following such switching off they can reverse the feed of the adhesive rod, thereby effectively causing adhesive to be sucked back from the end of the nozzle, thereby avoiding drooling or other detrimental deposition of cement when not required.

Once the rollers 232 have engaged the shoe bottom, the shoe heel end positioning mechanism 86 can be moved to its out-of-the-way position without the shoe becoming destabilised; the shoe is of course at this stage held by the side clamping members 184 and by the toe support 30, as well as benefiting from the stabilising effect of the downward pressure applied by the rollers themselves. Once the shoe heel positioning mechanism 84 is removed, the heel band mechanism 150 is moved about its axis 166 to a position closely adjacent the heel end of the shoe, but stopping short of engagement therewith. In this condition, the wiper head 172 of the wiper mechanism 170 is advanced, the block 178 engaging with its wings **178*a* the back of the heel band 152 and urging it in that region against the shoe. In this way the wiper head 172 is positioned correctly in accordance with the heel end of the shoe; moreover, the last part of the heel band movement is thus parallel with the shoe bottom, thereby avoiding any tendency (which could have arisen with a purely arcuate movement of the heel band) to dislodge the heel end of the shoe on its last. The wings of the heel band 152 are then urged into embracing engagement with the heel end of the shoe under the action of piston-and-cylinder arrangement 162, whereupon the side clamping members 184** can be retracted.

With the shoe thus clamped the bar lock arrangement 126, by which the post 116 of the jack post 22 is held in its heightwise position, is released and an upward yielding pressure is applied by the piston-and-cylinder arrangement 122, the wiper plates 174 then being moved inwardly to wipe the lasting marginal portions in the heel seat region of the shoe over and press them against corresponding marginal portions of the insole, while said upward yielding pressure remains applied. (It will of course be appreciated that at this stage the bar lock arrangement 138, by which the toe support 30 is held is in its operative position remains applied).

With the wiper plates 174 in their inwiped position, the bar lock 126 is re-applied thus to lock the post 116 in relation to the casting 118, and bedding pressure is then applied through the composite unit of post and casting 116, 118 from the diaphragm piston-and-cylinder arrangement 206 acting through the lever 200; this bedding pressure thus urges the shoe upwardly against the under-side of the wiper plates 174. Bedding pressure remains applied according to the time required for ensuring a consolidated bond between the in-wiped lasting marginal portions and the corresponding marginal portions of the insole.

At the end of this dwell time the bedding pressure is relieved and the wiper head 172 is retracted, the wiper plates 174 retracting within the wiper head 172, and at the same time the bar lock arrangement 126 is released and the post 116 is retracted into the casting 118, while at the same time the abutment plate/datum 54 and blocks 32 are retracted to release the toe end of the shoe. It will thus be appreciated that at this time the shoe is held merely by the heel band 152. The heel band mechanism 150 is then caused to pivot about the axis 166 to move the shoe out of the operating locality of the machine, whereafter the shoe heel end positioning mechanism 86 can be returned to such operating locality in readiness for the next shoe to be operated upon, and at this time also the post 116 of the jack post 22 moves back to its loading position. With the shoe still held by the heel band 152, but thus moved radially away from the operating locality, the band is then rotated about the axis of the support rod 158 through approximately 180 degrees, according to the settings for the stop pins 322 which are engageable by the blocks 324. After such rotation, the shoe rests on the platform 330, with the heel end thereof on the pad 336. The pad 336 serves two functions: firstly it stabilises the shoe on the platform 330, and secondly it increases the frictional engagement between the shoe bottom and the platform.

In this condition the heel band 152 releases the heel end of the shoe, by the de-actuation of piston-and-cylinder arrangement 162, and the platform 330 is then advanced through a small distance to remove the shoe from the region of the band, the pad 336 serving to ensure that the shoe moves with the platform. The heel band 152 is then rotated back about the axis of the support rod 158, in readiness for an operation on the next shoe. Thereafter, the arm 344 is pivoted about its axis and engages the heel end of the shoe thus to ensure that the shoe moves as the platform is moved as described above; in addition, the arm, which carries a V-block for engaging the heel end of the shoe, serves once more to control to a limited extent the heel end of the shoe during its advancing movement. Thereafter, the frame 340 is moved transversely of the rear of the machine from its loading position into a position of alignment with one of the channels of the heat setting apparatus, and the slide 332 is then advanced under the action of piston-and-cylinder arrangement 342 thus to advance the shoe, supported by the platform 330, into the selected channel. Thereafter the slide 332 is retracted to its initial position, in which it can receive another shoe which has been lasted.

It should also be noted that after the wiper head 172 has been retracted as described above, the carriage 200 for the nozzles 192 and side lasting assemblies 230 can be retracted and returned to their initial positions in readiness for a next cycle of operation of the machine.

We claim:

1. A machine for lasting side and heel seat portions of shoes comprising:

a shoe support on the front of said machine for supporting, bottom up, a shoe comprising a shoe bottom on a last and an insole on the last bottom;

two side lasting assemblies arranged on the front of said machine one at each side of the shoe support, and; a heel seat wiper mechanism on the front of said machine comprising a pair of wiper blades, wherein the shoe support comprises:

a last pin for receiving the last pin hole of a shoe last, a toe support for supporting the toe end of a shoe supported by the last pin, and a heel band mechanism for clamping the heel end of such shoe prior to the operation of the heel seat wiper mechanism, wherein the heel band mechanism is mounted for rotation movement rearwardly about an axis extending transversely of a shoe, the heel end of which is clamped thereby, wherein after a heel seat lasting operation has been performed on the heel seat of the shoe and following retraction of the last pin while the heel end of the shoe remains clamped by the heel band mechanism, rearward rotation of said heel band mechanism is effective to remove the shoe from the operating locality of the machine, wherein a shoe receiving device is provided at the rear of said machine for receiving a shoe which is held by the heel band mechanism when rotated as aforesaid, the shoe being released onto said device from said heel band mechanism.

2. A machine according to claim 1 wherein rotation of the heel band mechanism is effective to invert the shoe, which is thus released on to said device in . inverted condition.

3. A machine according to claim 1 wherein the shoe-receiving device comprises a platform which is movable between a plurality of positions in each of which the platform is aligned with a work station of a further machine, from which platform a shoe placed thereon can be advanced on to the work station with which the platform is thus aligned.

4. A machine according to claim 3 wherein the platform is constituted by a generally planar portion of a flexible member which at its end remote from the operating locality of the machine extends over a pulley or the like, the portion of said member beyond said pulley or the like extending at an angle away from the plane of said planar portion, the arrangement being such that as the portion constituting the platform is advanced, carrying therewith a shoe placed thereon, it progressively moves out of said plane and thus releases such shoe on to the aligned work station.

5. A machine according to claim 3 wherein after a shoe has been received on to the platform initially the platform is advanced through a distance to release it from the heel bend mechanism which is thus rotated out of the way.

6. A machine according to claim 3 wherein a pusher member is mounted for movement with the platform, said member being movable between an operative position in which it engages a shoe received on the platform and an out-of-the-way position.

7. A machine according to claim 1 wherein the heel band mechanism is movable between an operative position, in which it can clampingly engage the heel end of a shoe supported by the last pin of the shoe support, and an out-of-the-way position, and wherein the heel band mechanism is moved to its out-of-the-way position, carrying the shoe clamped thereby, after such shoe has been lasted, and in such position rearward rotation of the heel band mechanism then takes place as aforesaid.

8. A machine according to claim 1 wherein the shoe support also comprises a shoe heel positioning mechanism comprising a datum member engageable by the heel end of a shoe supported by the last pin for positioning it in a direction extending lengthwise of the shoe, and a heel seat height gauge device whereby the height of the bottom of such shoe in the heel seat region thereof can be set, and wherein the shoe heel positioning mechanism and the heel band mechanism are each movable between an operative and an out-of-the-way position, the arrangement being such that the positioning mechanism is first brought to its operative position, thus to position a shoe supported by the last pin as aforesaid, and thereafter said mechanism is moved to its out-of-the-way position and the heel band mechanism is moved to its operative position.

9. A machine according to claim 8 wherein the heel band mechanism, while in clamping engagement with a shoe as aforesaid, is moved to its out-of-the-way position prior to rearward rotational movement thereof being effected.

10. A machine according to claim 8 wherein the last pin is carried by a post mounted for sliding heightwise movement in a mounting therefor to bring the heel seat region of a shoe supported by the last pin to a desired heightwise position, a locking arrangement being provided for locking the post in position on said mounting, and wherein the mounting is mounted for pivotal movement about an axis extending transversely of the bottom of a shoe whereby to facilitate the movement of the heel end of the shoe into engagement with said datum member.

11. The machine according to claim 1 wherein the shoe receiving device comprises a platform on to which a shoe is transferred by the heel band mechanism, and wherein after a shoe has thus been received the platform is advanced through a distance to release it from the heel band mechanism which is then rotated out of the way.

* * * * *